United States Patent [19]

Stearns

[11] Patent Number: 5,006,903

[45] Date of Patent: Apr. 9, 1991

[54] SHEET SEPARATING DEVICE AND APPARATUS FOR USE THEREIN

[75] Inventor: Floyd E. Stearns, Warsaw, N.Y.

[73] Assignee: Eastman Kodak Company, Rochester, N.Y.

[21] Appl. No.: 422,316

[22] Filed: Oct. 16, 1989

[51] Int. Cl.[5] ..... G03G 21/00

[52] U.S. Cl. ..... 355/308; 271/121; 271/122; 271/125; 355/313

[58] Field of Search ..... 355/315, 313, 318, 319, 355/309, 308; 271/125, 121, 122, 35, 10

[56] References Cited

U.S. PATENT DOCUMENTS

| | | | |
|---|---|---|---|
| 2,665,906 | 1/1954 | Johnson . | |
| 3,372,925 | 3/1968 | de Vries et al. . | |
| 3,984,095 | 10/1976 | Zimmer . | |
| 3,990,694 | 11/1976 | Mason . | |
| 3,991,998 | 11/1976 | Banz et al. | 271/125 |
| 4,054,092 | 10/1977 | Loftus et al. . | |
| 4,203,586 | 5/1980 | Hoyer | 271/125 X |
| 4,496,145 | 1/1985 | Fukui . | |
| 4,500,084 | 2/1985 | McInery . | |
| 4,546,963 | 10/1985 | Dinnissen . | |
| 4,638,987 | 1/1987 | Sakurai . | |
| 4,844,435 | 7/1989 | Giannetti et al. | 271/35 X |
| 4,880,827 | 11/1984 | Shultz . | |

FOREIGN PATENT DOCUMENTS

| | | |
|---|---|---|
| 1071521 | 6/1967 | United Kingdom . |
| 1387817 | 3/1975 | United Kingdom . |

*Primary Examiner*—A. T. Grimley
*Assistant Examiner*—Thu A. Dang
*Attorney, Agent, or Firm*—Leonard W. Treash, Jr.

[57] ABSTRACT

A sheet separating device is particularly usable in an intermediate tray of a copier. A drive belt separates the outside sheet from a stack and feeds the sheet through a nip with a retard roller. The retard roller is braked by a motor. The motor is adjustable between a braking condition in which it prevents rotation of the retard roller when two sheets are in the nip and a free-wheeling condition in which it permits rotation when one sheet is in the nip. When applied to an intermediate tray of a copier, the logic and control of the copier knows when one sheet is left in the tray and switches the motor to its free-wheeling condition.

8 Claims, 2 Drawing Sheets

SHEET SEPARATING DEVICE AND APPARATUS FOR USE THEREIN

TECHNICAL FIELD

This invention relates to sheet separating devices, for example, a sheet separating device useable in an intermediate tray in a copier, printer or the like

BACKGROUND ART

Many commercial copiers use an intermediate tray, sometimes called a "duplex" tray for receiving copy sheets that have had one image tranferred to them. The sheets are later fed out of the imtermediate tray to receive a second image as properly controlled by a logic and control unit in the copier. This intermediate tray is used to make duplex copies and to make color copies. In the case of duplex copies, the opposite sides of the sheet receive the images, whereas with two-color copies the same side of the sheet receives two images. Duplex two-color copies can be made by feeding the sheet through the intermediate tray three times.

Sheets fed out of the intermediate tray are generally fed from the bottom. Feeding from the bottom is a difficult task. As a result vacuum rollers have been used for that purpose because of their reliability. However, vacuum rollers are expensive in both power and equipment and may increase the noise output of the machine. Scuff feeding devices are quieter and less expensive but have a tendency to be less reliable. In addition, the freshly fused image on the top of the sheet being fed can be damaged by a scuff pad or scuff roller.

The intermediate tray when used for both duplex and accent color may have sheets in it with images on either the bottom or the top side or both. These images are freshly fused powder images that are more easily disturbed immediately after exiting the fuser than they would be later. It is important that the separating process not disturb these images. It is also important that it not in any way damage the sheet because the sheet and must receive at least one more powder images and must support that image through fusing. Fusing performance is adversely affected by any irregularlity in the sheet.

U.S. Pat. No. 4,844,435 to Giannetti et al issued Jul. 4, 1989 describes a scuff separating device which feeds document sheets from the bottom of the stack using a retard roller which is braked. The brake on the retard roller prevents rotation of the roller when more than one sheet is in the nip but is overcome and permits rotation when one or no sheets are in the nip. This structure is extremely reliable in preventing double feeds and permitting the passage of a single sheet in highly demanding document feeding applications.

DISCLOSURE OF THE INVENTION

It is the object of the invention to provide a sheet separating device generally of the type described in the Giannetti et al patent but which has improved performance in some modes of operation.

It is another object of the invention to provide a reproduction apparatus generally of the type which has an intermediate tray in which an improved sheet separating device is used.

According to the invention, a brake on a retard member in a sheet separating device is adjustable between a first condition in which it exerts a brake force on the retard member sufficient to prevent rotation of said retard member when two sheets are in the separation nip but permit rotation when only one sheet is in the nip and a second condition in which the brake force is substantially reduced to facilitate feeding of a single sheet.

With the braking force on the retard member adjustable, it can be substantially reduced or eliminated when the logic and control of the apparatus recognizes that a single sheet is to go through a separating device thereby reducing damage to the single sheet.

This invention is particularly useable in the intermediate tray of a reproduction apparatus because the feeding of a single sheet constitutes a meaningful portion of its duty cycle; the apparatus generally includes a logic and control which, with its normal programming, has knowledge of the number of sheets in the intermediate tray; and the single sheet has a freshly fused powder image that is easily damaged.

BRIEF DESCRIPTION OF THE DRAWINGS

In the detailed description of the preferred embodiment of the invention presented below, reference is made to the accompanying drawings, in which.

BEST MODE OF CARRYING OUT THE INVENTION

Figure 1:
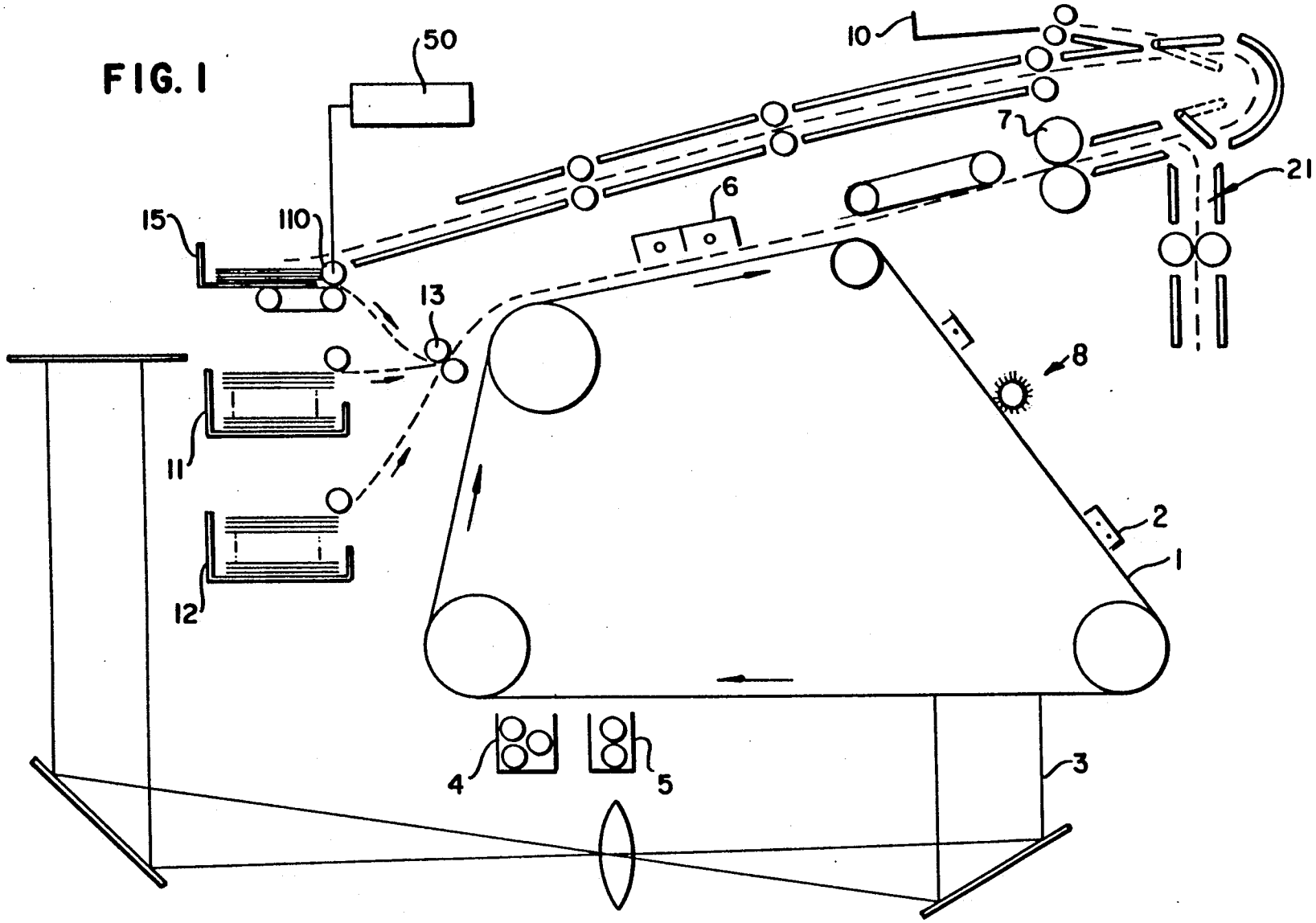
FIG. 1 is a schematic side view of a reproduction apparatus in which the invention is particularly useable.

According to FIG. 1 a known electrophotographic apparatus, for example, a copier, includes an image member, for example, electrophotographic web 1 which moves through a series of electrophotographic stations, well known in the art. Image member 1 is first charged by a charging station 2, exposed at an exposure station 3 to an optical image to create an electrostatic image. The electrostatic image is toned at one of toner stations 4 or 5 to create a toner image defined by the electrostatic image. The toner image is transferred to a receiving sheet at a transfer station 6 and is fed to a fuser 7 where it is fixed. The receiving sheet may be then moved to an output tray 10. The image member 1 is cleaned at a cleaning station 8 and reused.

Fresh receiving sheets are stored in first supply 11 or second supply 12. An appropriate size receiving sheet can be fed from either supply to transfer station 6 through a pair of timing rollers 13. If duplex copies are to be made, the receiving sheet is fed from the fuser 7 through an inverting path to an imtermediate tray 15. This deposits the receiving sheets in tray 15 with the image side up. If a number of copies are to be made of the same two images (or of different images in an automatic precollation mode) a substantial stack can be accumulated in intermediate tray 15. When the second side is to be imaged the receiving sheets are fed from intermediate tray 15 from the bottom of the stack to timing rollers 13 for presentation of the bottom side of the sheet to imaging member 1 at transfer station 6 to pick up the image for the opposite side. The sheet is then fed to output tray 10 with images on both sides.

If images of two different colors are to be placed on the same side of a receiving sheet, the receiving sheet receives the first image at transfer station 6, and is fused at fusing station 7 as before. However, this receiving sheet is fed first through a turnaround device 21 before following the same path as the preceding sheet back to intermediate tray 15. Turnaround device 21 assures that the path from transfer station 6 back to intermediate tray 15 is a noninverting path and therefore the image is on the bottom of the sheets in intermediate tray 15. When all of the first color images have been transferred to the receiving sheets that are stacked in intermediate tray 15 the sheets are then fed from the bottom through timing rollers 13 as before to transfer station 6 to receive the images of the different color to be added to the first images to the bottom side of the sheets. The sheets may then be fed to the output tray with two-color images on one side. With proper control of the apparatus, two-color images can be formed on both sides of the sheet without use of the turnaround 21 by doing one color on each side and then the other color on each side.

Toning station 4 is shown somewhat larger than toning station 5. In high volume copiers and duplicators it is conventional for the black toning station to be larger than the toning station containing an accent color, for example, red.

Continuous, off-the-bottom feeding out of the intermediate tray 15 of receiving sheets with freshly fused images must be carefully done. Freshly fused images are easily smudged, and feeding from the bottom without double feeds is technically challenging. Scuff feeding devices are the least expensive of all feeding devices and also use the least power and create the least noise. However, they have the greatest tendency to damage the sheets. A scuff separating device shown in FIGS. 2 and 3 creates a substantial improvement in scuff separating devices per se as well as in separating devices useable in intermediate trays.

Figure 2:
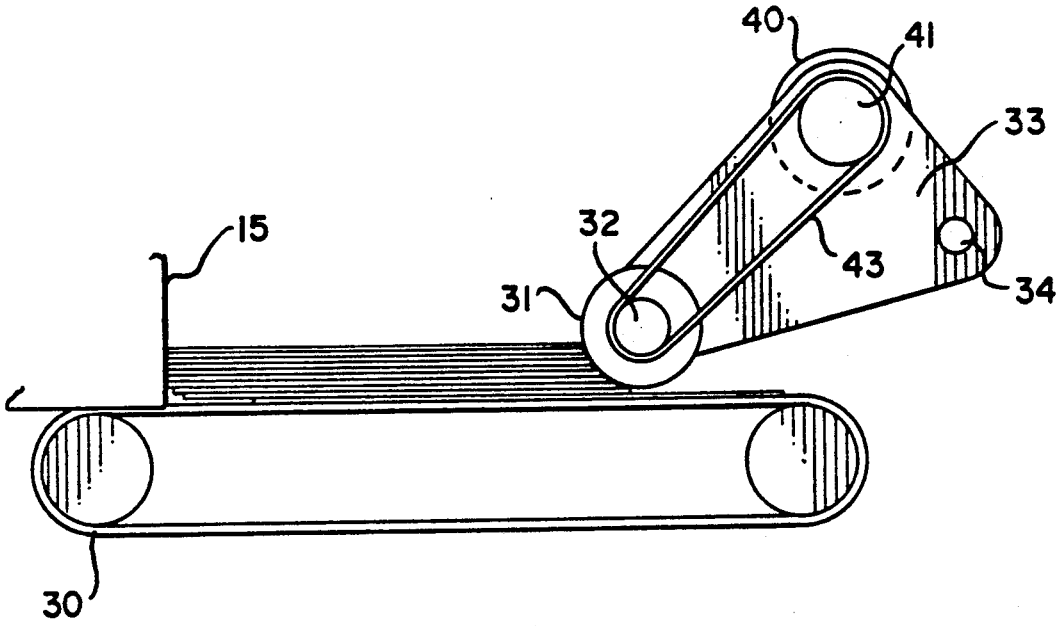
FIG. 2 is a side view of an intermediate tray with a separating device constructed according to the invention with many parts eliminated for clarity of illustration.
Figure 3:
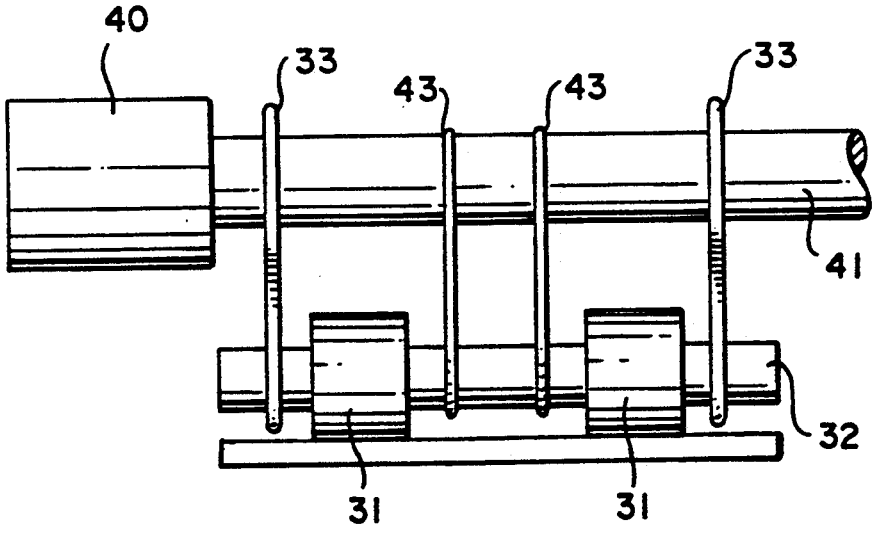
FIG. 3 is a top view of the separation device shown in FIG. 2 with many parts eliminated for clarity of illustration.

According to FIGS. 2 and 3, the scuff separating device includes a feed means, for example, a feed belt 30 which engages the bottom sheet of the stack and feeds the sheet in a path to the right, as shown in FIG. 2. Retard rollers 31 are supported on a shaft 32 supported in support plates 33. Support plates 33 pivot about a support rod 34 shown only in FIG. 2. Support rod 34 is downstream of a nip between retard rollers 31 and belt 30 and above the path of the sheet being fed. Retard rollers 31 are braked by a brake which includes a braking motor 40. Braking motor 40 has a shaft 41 mounted in support plates 33. O rings 43 are resiliently extended around shafts 32 and 41 providing a braking force to shaft 32 and hence to retard rollers 31 according to the disposition of motor 40.

Motor 40 is driven in a clockwise direction as seen in FIG. 2. Shafts 41 and/or 32 slip on O rings 43 but a braking force is applied urging retard rollers 31 also in a clockwise direction. The motor 40 is not strong enough to turn roller 31 against the peripheral force from the sheets. However, to prevent any such turning roller 31 may have a one-way switch, not shown. The coefficients of friction of belt 30 and the retard rollers 31 are higher than the coefficients of friction of the sheets. Therefore, as long as the retard rollers 31 are sufficiently braked by the motor 40 the bottom sheet will slide on the second sheet and be fed while the second sheet is held by non-rotating retard rollers 31.

According to the above-mentioned Giannetti et al patent the brake force can be accurately adjusted so that when a single sheet is in the nip between retard rollers 31 and belt 30, retard roller 31 will be rotated by the single sheet allowing it to be fed without the rollers 31 sliding on the surface of the sheet. Further, the pivot 34 about which the retard rollers 31 move is positioned to increase the separating force as the stack gets larger because of teh horizontal force of the stack against the rollers 31. Thus, the bottom sheet of the stack is fed by belt 30 through the nip while rollers 31 turn against the braking force of motor 40 until a second sheet enters the nip. At this point, the bottom sheet slides on the second sheet and the braking force stops movement of the second sheet. preventing a double feed.

However, with some sheets, a feeding of the last sheet is still difficult, and a freshly fused toner image on the top of such a sheet can become smudged even with the retard rollers 31 rotating. According to the invention, motor 40 is adjustable between at least two conditions. In its first condition it operates as described above providing the appropriate braking force to prevent turning of retard rollers 31 when two sheets are in the nip and allowing turning when one sheet is in the nip. In condition No. 2 less braking force is applied to retard rollers 31 making feeding of a single sheet easier. For example, motor 40 can be switched to a free-wheeling state in which it exerts no driving force on shaft 41 thereby permitting the single sheet in duplex tray 15 to drive roller 31 without overcoming any braking force beyond the inertia of the components.

This invention has particular application in an intermediate tray for three reasons. First, the intermediate tray commonly requires the feeding of sheets which have freshly fused images on their top sides which can be smudged by a braked retard roller. Secondly, the intermediate tray is controlled by a logic and control unit which logic and control unit, to perform its other duties, knows how many sheets are in the tray at all times. Therefore, it is a matter of routine programming to switch motor 40 to a free-wheeling state whenever the intermediate tray is down to a single sheet. As shown in FIG. 1, logic and control 50 is directly connected to motor 40 to adjust it between its free-wheeling and driving conditions. Third, duplex tray operation with only a single sheet is a common occurrence. In many applications, it makes up 50% of the job stream. Therefore, the need to reliably feed single sheets is critical.

Other adjustable braking devices can be used to adjust the brake force on rollers 31. For example, an electronic brake using a rotary solenoid actuable by logic and control 50 can be substituted for motor 40.

Although this invention is particularly useful in bottom feeding from an intermediate tray, it is not so limited. The invention can also be used with other bottom, or top or side feeding devices using a braked scuff roller. It may also be used in separating devices in which a roller is used rather than a belt to feed the outside sheet of a stack.

The invention has been described in detail with particular reference to a preferred embodiment thereof, but it will be understood that variations and modifications can be effected within the spirit and scope of the invention as described hereinabove and as defined in the appended claims.

I Claim:

1. A device for separating a sheet from a stack of sheets, said device comprising:

feed means for engaging an outside sheet of said stack and for feeding said outside sheet along a path, rotatable retard means for forming a nip with said feed means to prevent double feeds of said sheets between said feed means and said retard means, said retard means including a rotatable retard member, a brake for said retard member, said brake being adjustable between a first condition in which it exerts a first brake force on said retard member sufficient to prevent rotation of said retard member when two sheets are in said nip but permit rotation when only one sheet is in said nip, and a second condition in which said brake exerts a second brake force that is substantially reduced below the first brake force to facilitate feeding of a single sheet, and logic and control means having means for adjusting said brake from its first condition to its second condition when only one sheet remains in said stack of sheets.

2. The device according to claim 1 wherein said brake includes a motor, which motor is in a driving condition braking said retard member when said brake is in its first condition and in a free-wheeling condition when said brake is in its second condition.

3. The device according to claim 1 wherein said feed means is a belt which engages the bottom sheet of the stack.

4. The device according to claim 1 wherein said rotatable retard means includes two rotatable retard rollers both controlled by the same brake.

5. The device according to claim 1 wherein said rotatable retard means includes a pair of retard rollers supported by single shaft which shaft is supported by a pair of support plates and said brake is a motor having a shaft also supported by said support plates and the shaft for said retard rollers and the shaft for said motor are connected by a slippable drive means, rotation of said motor creating a force transmitted through said slippable drive means to the shaft of said retard rollers to apply a rotational braking force to said retard rollers.

6. A reproduction apparatus of the type including means for forming a series of toner images on an image member, means for feeding a receiving sheet into transfer relation with said image member.

means for transferring a first toner image to said sheet, means for feeding said sheet into an intermediate tray, means for feeding said sheet out of said intermediate tray and into transfer relation with said image member a second time, means for transferring a second toner image to said receiving sheet, characterized in that said means for feeding said sheet out of said intermediate tray includes the sheet separating device of claim 1.

7. Reproduction apparatus according to claim 6 wherein said logic and control means includes means for controlling the feeding of said sheets.

8. A reproduction apparatus comprising:

means for forming a series of toner images on an image member, means for feeding a receiving sheet into transfer relation with said image member, means for transferring a first toner image to said sheet, means for feeding said sheet into an intermediate tray, means for feeding said sheet out of said intermediate tray and into transfer relation with said image member a second time, means for transferring a second toner image to said receiving sheet, logic and control means for controlling the feeding of said sheets into and out of said intermediate tray, characterized in that said means for feeding said sheet out of said intermediate tray includes feed means for engaging an outside sheet in said intermediate tray, a rotatable retard member for preventing double feeds between said feed means and said retard member, a brake for said retard member, said brake being adjustable, in response to an electrical adjustment signal, between a first condition in which it exerts a brake force on said retard member sufficient to prevent rotation of said member when two sheets are in said nip and a second condition in which said brake force is substantially reduced to facilitate feeding of a single sheet, and wherein said logic and control includes means for creating said electrical adjustment signal when only one sheet is in said intermediate tray.

* * * * *